United States Patent [19]

Praska et al.

[11] 3,955,839

[45] May 11, 1976

[54] DOOR LATCH

[75] Inventors: George J. Praska, Crystal, Minn.; Daniel W. Wilson, Cameron, Wis.; Gerald E. Peterson, St. Paul, Minn.

[73] Assignee: Wright Products, Inc., St. Paul, Minn.

[22] Filed: Feb. 28, 1975

[21] Appl. No.: 553,878

[52] U.S. Cl. ..... 292/226

[51] Int. Cl.[2] ..... E05C 3/08

[58] Field of Search..... 292/200, 236, DIG. 38, 292/126, 226; 49/397

[56] References Cited

UNITED STATES PATENTS

| | | | |
|---|---|---|---|
| 1,569,697 | 1/1926 | Barclay | 292/126 |
| 2,087,143 | 7/1937 | Geske et al. | 292/226 X |
| 2,365,378 | 12/1944 | Benson | 49/397 X |

*Primary Examiner*—Richard E. Moore

[57] ABSTRACT

A "rivetless" surface-mounted latch wherein functional parts, e.g., a pivotal latch bolt and handle and locking piece, are positioned within a housing in stacked relation, each piece being retained by the one above, the entire assemblage being held together by a staked cover plate.

3 Claims, 7 Drawing Figures

112
50
134
132
130
128
98
56
20
126
116
110
122
124
120
60
114
118
16
80
106
108
82
84
92
96
58
104
44
48
42
46
78
52
86
40
88
18
64
38
62
54
74
70
72
68
66
102
106

DOOR LATCH

The present invention relates to door latches of the surface-mounted type frequently used on aluminum storm doors. The invention particularly concerns the surface-mounted door latch having a pivotal latch bolt used in connection with so-called "Z" bar door frame construction, wherein shaped extruded aluminum of generally Z shaped cross-section is mounted along the door frame serving as a stop for the door and as a strike or keep for the latch.

BACKGROUND OF THE INVENTION

Heretofore, surface-mounted door latches having pivotal latch bolts have required bolts or rivets upon which pivotally to retain the latch bolt. Frequently, the inside handle for actuating the latch bolt has also been mounted or journaled upon a rivet. While such constructions are quite suitable functionally, a considerable portion of the expense in manufacturing and assembly is attributable to the operation of drilling, inserting and staking the rivets.

SUMMARY OF THE INVENTION

In accordance with the present invention, a "rivetless" surface-mounted latch is provided wherein the need for mounting bolts or rivets upon which to retain the latch bolt, handle, or other functional part is obviated. Instead, each of the functional parts is assembled in its order within a housing wherein the second part retains the first in position, the third retains the second, etc., and only the final cover piece is staked into place. This operation requires no drilling, but simply the offsetting of bosses cast integrally with the housing extending through the cover and retaining it in place.

In preferred form, our latch mechanism contains the same desirable functional features of prior art latches wherein the moving or functional parts are mounted on rivets, such as inside locking means and latch "kick-off".

BRIEF DESCRIPTION OF THE DRAWING

The nature and advantages of our invention will become apparent upon reference to the following description, taken together with the accompanying drawing, wherein like reference characters identify corresponding parts in the several views, and in which.

DESCRIPTION OF PREFERRED EMBODIMENT

Figure 1:
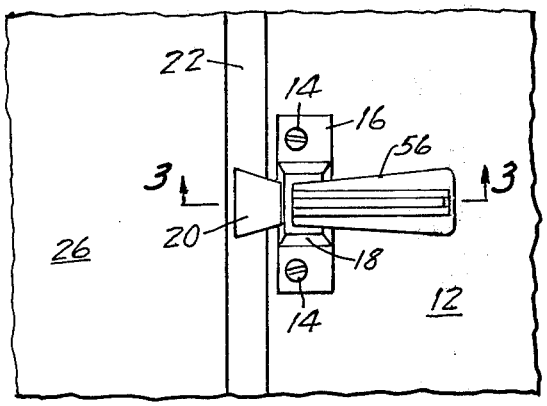
FIG. 1 is a front elevation of a portion of a door and door frame from the inside showing the latch assembly of the present invention in place.
Figure 2:
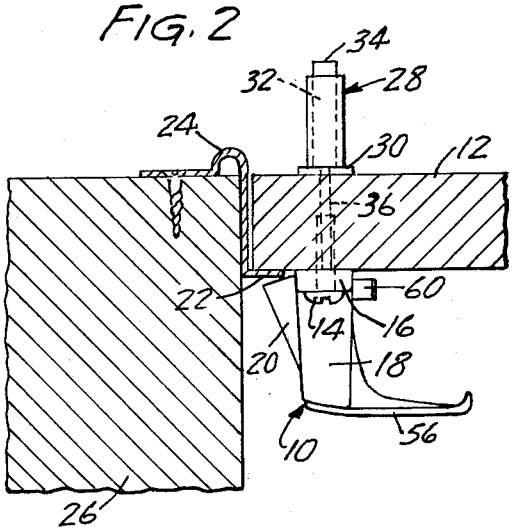
FIG. 2 is a section of the door and door frame of FIG. 1 showing the latch mechanism in relation to an extruded "Z" bar mounted on the door frame.

Referring to FIGS. 1 and 2 of the drawing, a preferred form of the latch assembly of the present invention is seen to consist of an inside surface-mounted assembly 10 mounted on the surface of door 12 by means of screws 14 extending through the base 16 of latch housing 18. The assembly is so mounted in position that the latch housing clears, while the latch bolt 20 overlaps the flange or stop portion 22 of a conventional Z bar portion 24 of door frame 26.

On the outside of door 12 is mounted the outer latch assembly 28 of conventional construction having a handle grip 30 wherein is retained a keylock cylinder 32 and associated depressible thumb button 34. A spindle 36 of rectangular cross-section extends through the door and into the inside assembly 10 either to retract the latch bolt upon being depressed with thumb button 34 or to lock or unlock the assembly upon turning of the keylock. Our invention can be adapted to any conventional outer latch assembly of this general type.

As more particularly shown in FIGS. 3–7, the inside latch assembly 10 of the present invention is comprised of a housing 18 formed of two symmetrical halves 38 and 40. The base 16 of the housing 18 is made up of a lateral projection 42 extending from each of the said housing halves 38 and 40. The base projections 42 each contain a hole 44 accommodating screws 14 for mounting the assembly 10 to the surface of the inside of the door. Each of the base projections is further provided with a rim 46 and ribs 48. Seated within the rim and supported by the ribs is a cover 50 fitting flush into the base. Following assembly, the cover 50 is retained in place by upsetting bosses 52 of the housing halves 38 and 40 which extend through the cover in a staking operation to retain the cover in place.

The cover 50, as will be explained, retains the functional parts of the latch assembly. Significantly, no bolts or rivets are necessary to retain or anchor any of the functional parts. The bosses 52 are simply upset or staked over the cover 50 as a final step in the assembly of the latch.

The two halves 38 and 40 making up the housing 18 are joined at the end opposite the base by bar 54. Normally the entire housing is cast, e.g., from zinc, in a single piece.

Figure 3:
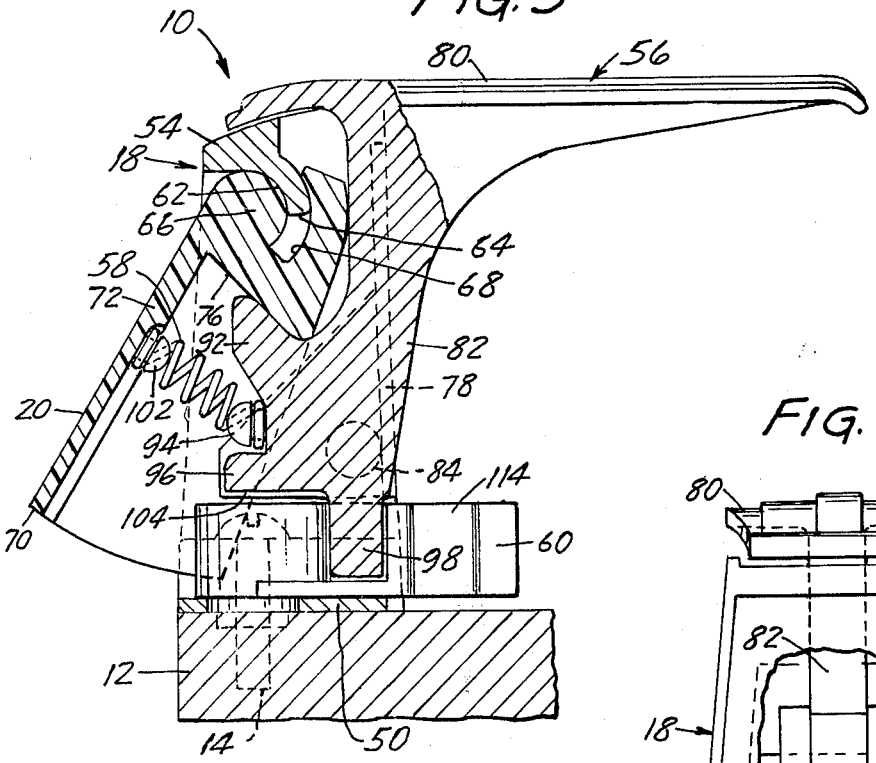
FIG. 3 is an enlarged section of the surface-mounted door latch assembly mounted on the inside of the door taken along the lines 3—3 of FIG. 1.
Figure 4:
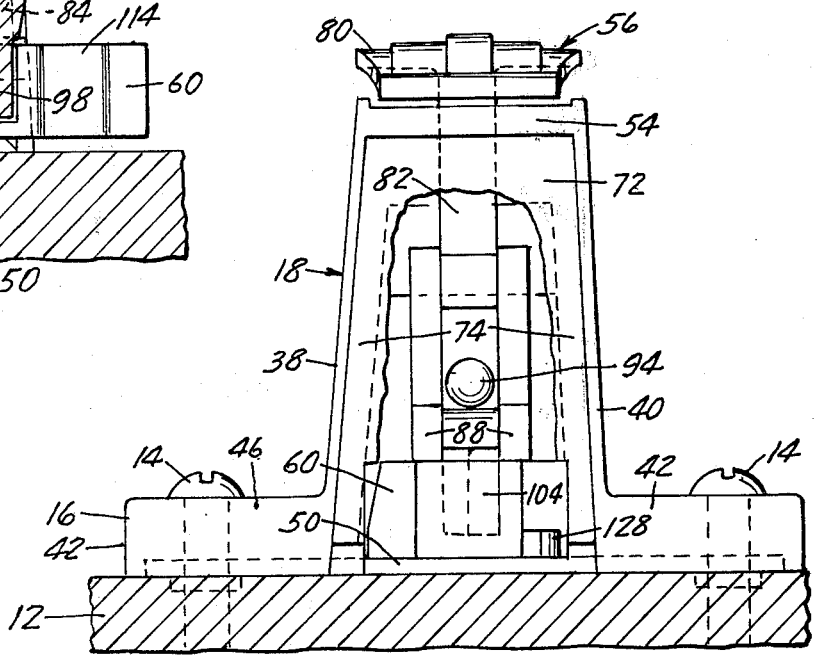
FIG. 4 is an end view of the inside mounted latch assembly of FIG. 3 wherein the latch bolt is shown as partly broken away to expose the interior.
Figures 5, 6, 7:
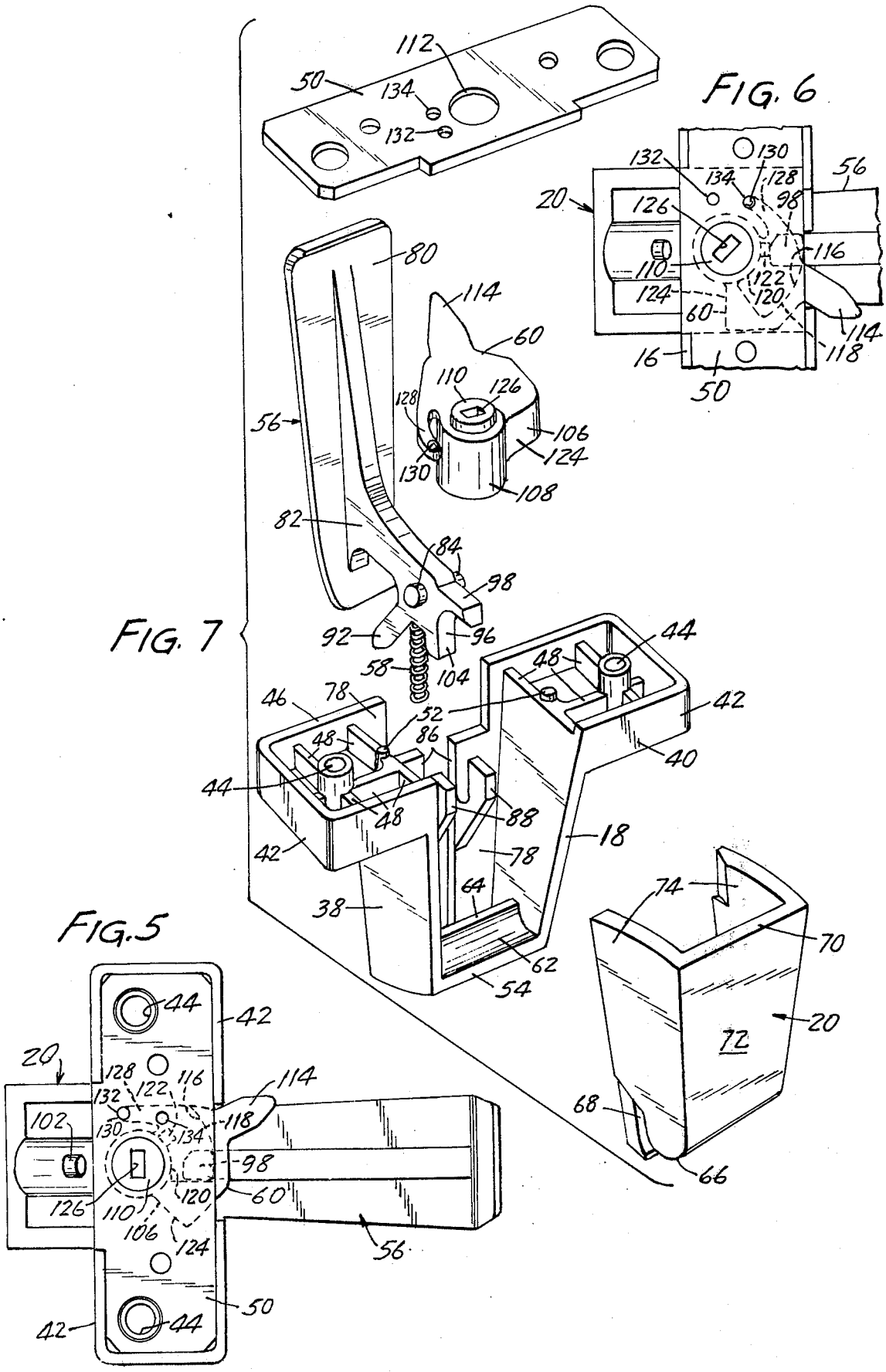
FIG. 5 is a bottom view of the latch assembly of FIG. 3 showing the locking piece in the unlocked position.
FIG. 6 is a bottom view similar to FIG. 5 partially broken away showing the locking piece in the locked position.
FIG. 7 is an exploded view of the inside surface-mounted assembly of FIG. 1.

As especially shown in FIG. 7, the functional parts of the inside latch assembly retained within the housing 18 are—in the order of assembly—latch bolt 20, handle 56 (containing compression coil spring 58), and locking piece 60. Thus, the interior of bar 54 is provided with a concave bearing surface 62 having a transversely extending ridge 64 of arcuate cross-section (FIG. 3). Latch bolt 20, which may be composed of molded plastic such as nylon, is formed with a rounded end 66 having a transverse arcuate slot 68, said rounded end and slot mating respectively with the bearing surface 62 and ridge 64 of the housing. The latch bolt rides in the bearing surface in pivoting from the front opening of the housing defined by the housing halves 38 and 40. In order that the movement of the latch bolt be a smooth, pivoting motion, the center of curvature of the arcuate ridge 64 of the housing and the mating slot 68 of the latch bolt center at the axis of pivot of the latch bolt.

The back (interior side) of the latch bolt 20 is recessed from its free end 70 (FIGS. 3 and 7) to define front wall 70, side walls 74 and inclined bottom surface 76. Other mechanism is accommodated within this recess such that in its retracted position the bolt recedes within the housing with the side wall 74 abutting the interior surfaces or rear flanges 78 in the housing halves 38 and 40, with the front surfaces of the bolt substantially flush with the housing. Upon being pivoted forwardly to the extended or latched position, the latch bolt 20 protrudes from the housing with its free end extending a substantial distance beyond the housing due to its elongate nature and extended arc, all to the end that the bolt properly overlaps the Z bar 24 or other keeper on the door frame (FIG. 2).

The configuration of the arcuate ridge 64 in the housing and the mating slot 68 of the latch bolt 20 allow the latter to be readily inserted and set into position on the bearing surface 62 and the ridge 64 from the front of the housing during assembly. So long as urged against the bearing surface, the ridge prevents the bolt from being displaced, while allowing the desired pivotal action of the latch bolt. Hence, it is unnecessary to drill the housing and insert a bolt or a rivet upon which to retain the latch bolt, as has been the case in commercial prior art devices.

Overlapping the retaining the latch bolt is one-piece cast handle 56 formed into an exterior pressure bar 80 and interior extension 82 disposed approximately at a right angle with respect ot the pressure bar. The handle is mounted in the housing by a pair of opposed cylindrically shaped posts 84 extending laterally on each side of the extension 82. These posts combine to define a mounting axle which rides within a pair of slots 86 disposed within mounting brackets 88 protruding one from each of the flanges 78 of the housing halves 38 and 40. The retaining slots 86 open to the base end of the housing 18 to allow the handle to be set into place, following placement of the latch bolt 20, with the extension 82 passing between the inner opposed edges of rear flanges 78 in the back of the housing. When seated, the handle pivots about the mounting posts.

Projecting from the extension 82 of handle 56 and cast therewith are four items (see FIGS. 3 and 7): camming finger 92, spring mounting knob 94, anvil 96, and lock post 98.

The camming finger 92 is configured to extend over the aforementioned inclined surface 76 in the back of the latch bolt 20. Due to the slope of surface 76 forwardly toward the slotted end of the latch bolt, the camming finger 92 will be seen to achieve two main functions. First, in bearing against the inclined surface, the latch bolt is retained by the finger and prevented from pivoting too far forward and off of the transverse ridge 64. Secondly, as the handle is depressed clockwise as shown in FIG. 3, for example, to unlatch and open the door, the finger 92 moves about post 84 bearing against the camming surface 76, causing the latch bolt to pivot on the ridge about bearing surface 62 from the normal latching position shown, to the retracted or unlatched position so as to clear the Z bar (FIG. 2) or other keeper in the door frame, and allowing the door to open.

The aforementioned coil spring 58 is fastened at one end on spring retaining knob 94 of the handle extension 82, and is seated at its other end on a corresponding nodule 102 in the interior front wall 72 of the recess in the latch bolt 20. Upon depression of the handle 56 to cam the latch bolt to the retracted position, spring 58 is compressed from the normal position so as, upon release of the handle, to return the latch bolt to the extended or latched position.

The anvil 96 protrudes from extension 82 of handle 56 approximately parallel with the base of the latch assembly when the handle is in normal position, and because of the rather short length of the anvil, this position does not substantially change upon rotation of the handle in its pivoting movement. The anvil presents an abuttment surface 104 (FIGS. 3 and 7), which is contacted by spindle 36 (see FIG. 2) upon depression of thumb button 34 of the assembly mounted on the outside of the door. Upon being thus contacted, the anvil also depresses, causing the handle to pivot and finger 92 to cam the latch bolt to a retracted position against the force of spring 58.

Overlying and set upon lock post 98 of handle extension 82 is locking piece 60, which may be composed of molded plastic, e.g., nylon, the configuration of which is best seen in FIGS. 5, 6 and 7. The locking piece comprises a body 106, near one end of which is formed a hub 108. On the surface of the hub adjacent the base of the latch is a circular bearing 110 which rotatably seats in bearing aperture 112 in cover 50. At the other end of the body 106 of the locking piece is actuation tab 114 which protrudes from the rear of housing 18.

The portion of the body 106 immediately outlying the hub 108 is recessed from the surface opposite bearing 110 to define a slot 116 into which protrudes the post 98 of handle 56 (FIGS. 5 and 6). The radially outer wall 118 of slot 116 is arcuate, having a center of curvature coinciding with the center of hub 108 and bearing 110. Post 98 bears against wall 118 when the locking piece is rotated from the locked to the unlocked position.

The inner wall 120 of slot 116 is configured to allow post 98 to move unimpeded upon depression of handle 56 when the locking piece is in its normal position. However, a protrusion 122 extends radially from the inner wall 120 which becomes interposed against post 98 when, by shifting tab 114, the lock is pivoted to the locked position, as shown in FIG. 6. In this position, post 98 cannot move; and thus depression of the handle to retract the latch bolt is prevented.

When the locking piece is in the locked position as shown in FIG. 6, the outer surface 124 of the body 106 is presented to the edge of one of the side walls 74 of the latch bolt 20. Should the latch be depressed, as when the door is slammed shut with the locking piece in the locked position, the latch bolt, upon striking the Z bar, is urged to the depressed or retracted position. The edge of the latch bolt strikes the surface 124, this action forcing the locking piece to rotate and shift to the unlocked position, giving an automatic kickoff action to our novel latch assembly.

The hub 108 of the locking piece contains a slot 126 through which extends the spindle 36 from the outer latch assembly. In moving lengthwise in response to depression of thumb button 34, the spindle slips with respect to the locking piece so as to actuate the handle as above described. When rotated, however, as by rotating the key cylinder in the outer assembly in response to turning of the key, spindle 36 serves the function of rotating the locking piece from the locked to the unlocked position, and vice versa.

The locking piece 60 is also provided with an integrally formed arcuate detent 128 which is cantilevered from actuation tab 114 concentrically with and spaced slightly from hub 108. A protrusion 130 extends at the end of detent 128 from the surface thereof adjacent cover 50. By its cantilevered attachment, detent 128 has resiliency and cooperates with holes 132 and 134 provided on the cover to retain the locking piece 60 into whichever of its two positions it is put, yet allowing the lever to be shifted manually against the force of the detent. Thus, when the locking piece 60 is in the unlocked position, protrusion 130 of detent 128 seats in hole 132. Upon moving actuation tab 114 to shift the locking piece to the locked position, detent 128 yields, protrusion 130 sliding out of hole 132 along the inside surface of cover 50 until it finds and seats in hole 134, thereby to yieldably retain the locking piece 60 in the locked position.

As apparent from the foregoing description, none of the functional parts in our novel latch assembly depends on any externally affixed bolt or rivet for retention or rotation. Rather, the parts are assembled in stacked relation, each part being held in place by another, akin to the "Chinese Puzzle", except for the cover piece which is staked into position following assembly. Thus, the latch bolt 20 is first set in place from the front of the housing, following which the handle 56 with spring 58 attached is set into the housing from the rear (with the latch bolt held in retracted position such that camming finger 92 slides over the inclined surface 76 of the latch and the spring seats upon nodule 102 as the posts 84 slide into position in slots 86). Then locking piece 60 is placed upon post 98, following which the cover 50 is put into position with the bearing 110 seated in bearing aperture 112 of the cover, and as a final operation, the cover is staked into position by upsetting of the bosses 52.

Various advantages inhere in our novel construction. For example, the latch bolt 20 may be quite long, extending almost to the point of cover piece 50. Or it may be shortened as desired, to accommodate nearly any design of Z bar or other form of keeper for surface-mounted storm door locks.

What we claim is:

1. A surface-mounted door latch comprising:

a housing having a bearing surface, a latch bolt set on said bearing surface for pivotal movement from an extended position to a retracted position, tongue and groove means associated between said latch bolt and said housing confining the latch bolt to a pivoting motion when in position on said bearing surface, a handle pivotally mounted over said latch bolt on an axis spaced from that upon which said latch bolt pivots, said handle retaining the latter in position on said bearing surface, spring means urging the latch to an extended latching position, and means on said handle for camming the latch bolt to the retracted position.

2. A surface-mounting door latch comprising a housing retaining in stacked relation as assemblage of an elongate pivotal latch, a handle, and a locking piece, said housing having a base at one end thereof and at the other end an interior latch bearing surface including a transverse ridge, an opening to the front of the housing through which a latch pivots about said bearing surface, an opening on the back through which the handle pivots, and interior means for pivotally retaining said handle set thereinto from said base end;

said latch being set within said front opening for pivoting on said bearing surface and having a transverse slot in the end thereof mating with the ridge in said housing, with the opposite end of the latch adjacent the base of said housing moving from a retracted position to an extended latching position;

the back side of said latch being recessed to define a transverse inclined camming surface sloping forwardly and toward said slotted end;

said handle being pivotally set in the retaining means of the housing and projecting from said opening in the back side thereof;

the portion of said handle within the housing containing a finger extending over and engaging said inclined camming surface limiting the forward pivotal movement of said latch and camming the latch to the retracted position upon pivoting of the handle;

spring means urging the latch to the latching position; and means securing the assemblage in said stacked relation within said housing.

3. The latch of claim 2, wherein said securing means is a locking piece set over said handle and being movable from a normal to a locking position, the locking piece, upon being so moved, preventing pivoting of the handle in resistance to pressure applied thereto; and a cover plate affixed to the base of said housing retaining said locking piece in position to secure the assemblage in stacked relation.

* * * * *

UNITED STATES PATENT AND TRADEMARK OFFICE

CERTIFICATE OF CORRECTION

PATENT NO. : 3,955,839

DATED : May 11, 1976

INVENTOR(S) : George J. Praska et al

It is certified that error appears in the above-identified patent and that said Letters Patent are hereby corrected as shown below:

Col. 2, l. 58, after "rides", change "in" to -- on --.

l. 63, after "and" add -- of --.

l. 64, change "center at" to -- generally coincides with --.

Col. 3, l. 23, change "the" (first occurrence) to -- and --; and after "bolt" add -- in place --.

l. 26, change "ot" to -- to --.

Signed and Sealed this

Nineteenth Day of October 1976

[SEAL]

*Attest:*

RUTH C. MASON
*Attesting Officer*

C. MARSHALL DANN
*Commissioner of Patents and Trademarks*